US005803783A

United States Patent [19]

Holmstrøm et al.

[11] Patent Number: 5,803,783

[45] Date of Patent: Sep. 8, 1998

[54] TOY BUILDING SET WITH WALL ELEMENTS

[75] Inventors: Berit Holmstrøm, Gadstrup; Charlotte Katharina Høyer Højlund, Virum, both of Denmark

[73] Assignee: INTERLEGO AG, Baar, Switzerland

[21] Appl. No.: 617,911

[22] PCT Filed: Sep. 21, 1994

[86] PCT No.: PCT/DK94/00358

§ 371 Date: Mar. 19, 1996

§ 102(e) Date: Mar. 19, 1996

[87] PCT Pub. No.: WO95/08579

PCT Pub. Date: Mar. 30, 1995

[30] Foreign Application Priority Data

Sep. 22, 1993 [DK] Denmark ..... 1070/93

[51] Int. Cl.[6] ..... A63H 33/08

[52] U.S. Cl. ..... 446/128; 446/102; 446/110

[58] Field of Search ..... 446/102–104, 446/128, 110; D21/108

[56] References Cited

U.S. PATENT DOCUMENTS

D. 308,234 5/1990 Fish, Jr. ..... D21/108

D. 309,332 7/1990 Olsen ..... D21/108

5,154,656 10/1992 Milstein ..... 446/110 X

FOREIGN PATENT DOCUMENTS 373298 12/1963 Switzerland .

1049484 11/1966 United Kingdom ..... 446/128

*Primary Examiner*—Robert A. Hafer

*Assistant Examiner*—Jeffrey D. Carlson

*Attorney, Agent, or Firm*—Kane, Dalsimer, Sullivan, Kurucz, Levy, Eisele and Richard, LLP

[57] ABSTRACT

A toy building set containing wall elements for the construction of facade structures. The building set includes at least one of each of two types of wall elements: a first type of wall element formed with one opening having hinge parts for suspension of plate elements; and a second type of wall element formed with a plurality of openings, each having hinge parts for suspension of plate elements. The height of the openings in each type of wall element are equal so that the plate elements may fit into the openings of either type of wall element.

6 Claims, 2 Drawing Sheets

TOY BUILDING SET WITH WALL ELEMENTS

BACKGROUND OF THE INVENTION

1. Field of the Invention

The present invention concerns a toy building set with wall elements which are constructed as box-shaped elements having outer and inner facade sides, said inner facade side being open, said wall elements comprising a first type having at least one opening in the outer facade side, said opening serving as a window or a door in the element, and a second type formed with partitions to define shelves having shelf openings in the inner facade side of the element, hinge parts being provided at the window openings or the door openings and the shelf openings for the mounting of a removable, pivotable plate element.

2. Description of the Prior Art

These wall elements may thus be used for the construction of facades of a toy house in which windows or doors may selectively be mounted on the outer side of the facade and shelf systems may be provided on the inner side of the facade. Since the wall elements thus comprise a type which is provided with shelves on the inner facade side of wall elements, this prior art provide the advantage that it is not necessary for the toy building set to use separate shelf elements for mounting interiorly in a toy house which is constructed from the wall elements, since the shelf parts are built into individual ones of the elements.

These known elements e.g. from U.S. Pat. Design No. 291,217, may moreover be provided with doors and windows, as needed.

Thus, when these wall elements are used in connection with toy building sets, the interconnection of the elements may be varied to a very great extent, such that a relatively small number of elements provides many possible variations for the construction of toy houses.

SUMMARY OF THE INVENTION

In this connection, it is the object of the present invention to provide a toy building set with wall elements which, other things being equal, is capable of offering even more variations for the construction of toy houses, using the same number of or fewer individual parts in the toy building set.

This is achieved using wall elements of the type mentioned in the opening paragraph, which are constructed such that the hinge parts of the door or window openings and the shelf openings are identical, and in that the size of the window openings and of the shelf openings corresponds to integer multiples of the size of the plate element.

Since the plate element may thus constitute a door, a window or the like, it is possible to change these plate elements about, so that the plate element may have several functions. This means that e.g. a plate element intended for use as a window in a facade element can also be used as a door in the system of shelves, i.e. the interior which is established in the construction of a toy house. In contrast, a plate element according to the prior art intended to be included in the toy building set as a window element can just be used for this purpose.

Thus, the use of the wall elements of the invention makes it possible to build a house facade with e.g. windows which are completely open, i.e. no pivotal plate elements are mounted in the window opening, without the plate elements necessarily being superfluous since these may be used in this situation as doors for the shelves on the inner side of the house facade.

Particularly discrete hinge parts without protruding parts are obtained when the hinge parts are positioned interiorly in the door or window openings and the shelf openings on the elements, as stated in claim 2.

The door or window openings and the shelf openings may either be provided with hinge parts just at one side of the openings, or at both sides of the openings, as stated in claims 3 and 4, thereby enabling the plate elements to be positioned in different ways in the openings.

The engagement means defined in claim 5, which protrude into the openings, ensure that the plate elements cannot be pressed into the wall element.

It is stated in claim 6 that the wall element may have the same outer dimensions, although this is not a prerequisite for the advantages of the invention to be achieved. However, this ensures that the wall elements are mutually exchangeable in a given wall structure, such that the construction of a wall structure may be varied additionally.

BRIEF DESCRIPTION OF THE DRAWINGS

Expedient embodiments of the invention will be described below with reference to the drawing, in which.

DETAILED DESCRIPTION OF THE PREFERRED EMBODIMENTS

Figure 1:
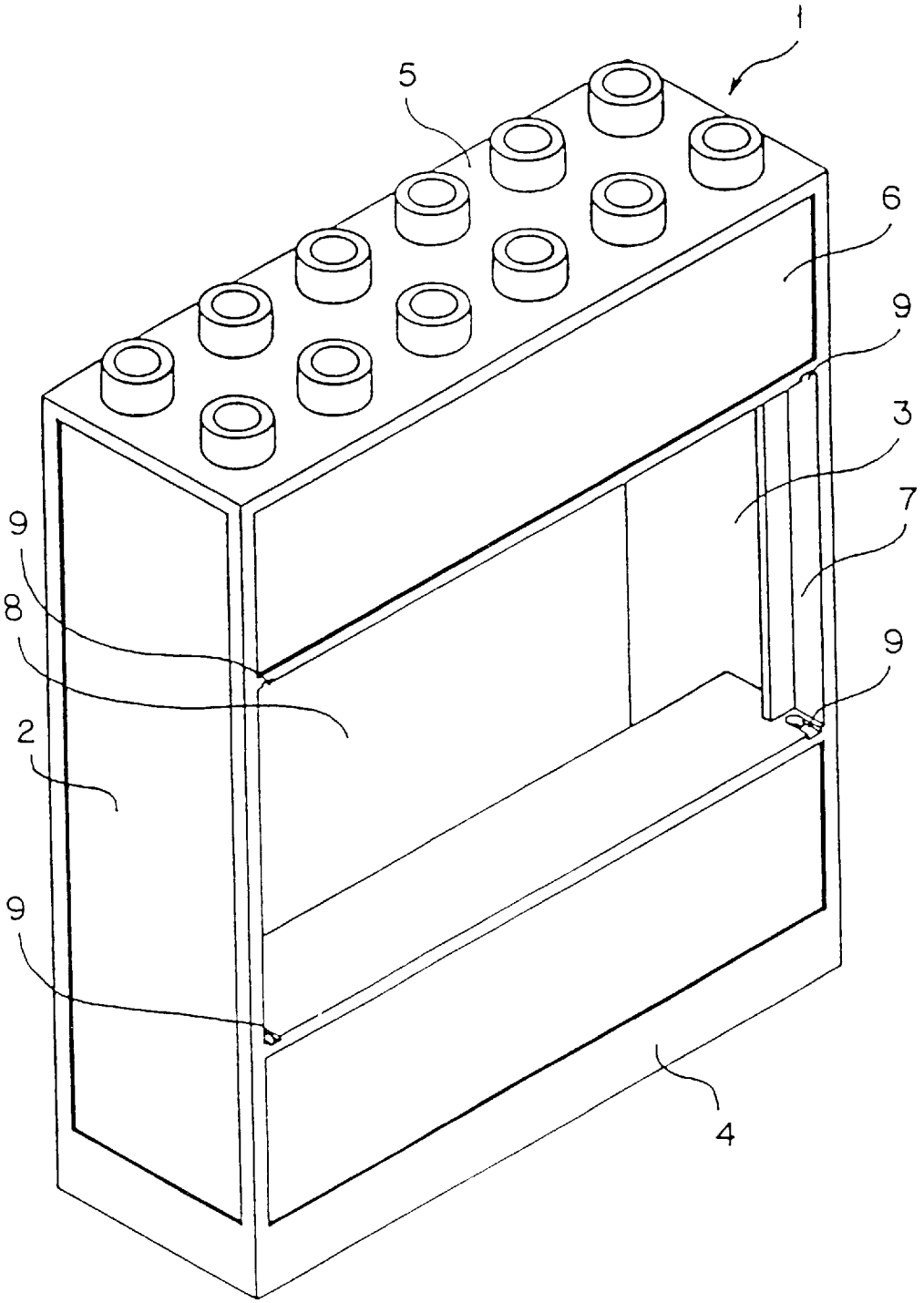
FIG. 1 is an oblique front and top view of a first wall element according to the invention with a window opening.
Figure 2:
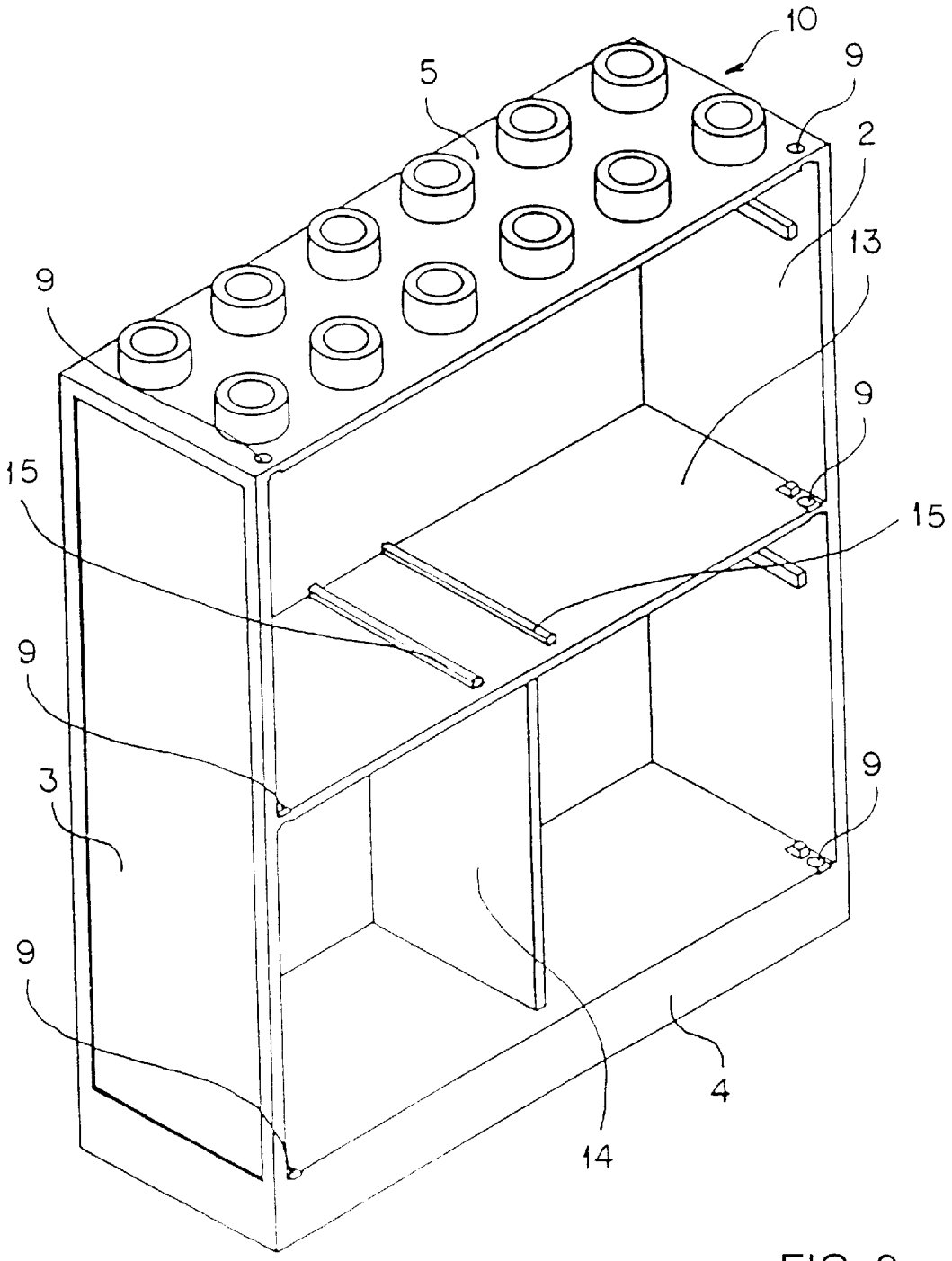
FIG. 2 is an oblique top and rear view of a second element according to the invention with shelf parts.

According to the invention, a toy building set comprises two types of wall elements, which may each be represented by the wall elements according to FIG. 1 and FIG. 2, respectively.

FIG. 1 thus shows a wall element 1 which is constructed as a box-shaped element having two side faces 2 and 3, as well as a base 4 and a top face 5. In addition, the wall element 1 has an outer facade side 6 which is formed with a window opening 7, as well as an inner facade side 8 which is open.

The wall element 1 with a window may thus be used as part of a wall structure, since the element may be built together with other similar elements, e.g. the element shown in FIG. 2.

The window opening 7 in the wall element 1 is provided with hinge parts 9 at both sides in which a pivotable and removable plate-shaped element may be mounted; this element is not shown for clarity, but is of a generally known type, which may e.g. be constructed as a window or a shutter. The plate-shaped element is provided with hinge parts in a known manner which are complementary to the hinge parts 9, so that the plate-shaped element, following mounting in the hinge parts 9, may be opened and closed.

FIG. 2 thus shows the second type of wall element 10, which is likewise open on the inner facade side, and which likewise comprises side faces 2 and 3, as well as a base 4 and a top face 5. The outer facade side is completely closed here, so that the outer facade side of the wall presents a plane face. In addition, this element 10 is provided with a system of shelves on its inner facade side, since the partitions 13 and 14 divide the interior of the element into separate compartments which thus constitute the system of shelves. The openings of the system of shelves are directed toward the inner facade side of the wall element and are provided with hinge parts 9, which are identical with the hinge parts shown in FIG. 1.

According to the invention, and as shown in FIGS. 1 and 2, the shelf openings on the wall element 10 and the window opening on the wall element 1 are dimensioned such that windows, shutters or the like which fit into the hinge parts 9 on one element, also fit into hinge parts 9 on the other element.

It is hereby ensured that the wall element may be used both with and without windows, shutters, doors or the like. In addition, these windows, shutters, doors or the like may selectively be placed in one or the other element so as to provide a far greater range for the variation of the use of these elements.

It is clear that these shown embodiments of the basic principle of the invention may be varied in many ways; thus, the outer dimensions of the wall elements may be the same or different, as needed, although it is preferred that they are the same, since this provides additional possibilities of varying the construction of a wall facade. In addition, the compartmentalization in the wall element 10 may be such as to provide a larger number of compartments, and the positions of these may be varied.

Similarly, the opening, which is a window opening in FIG. 1, may equally well be a door opening, so that the wall element constitutes a door element. As stated above, the wall element to be mounted in the hinge part 9 in the openings of the wall elements 1, 10 may be constructed in many ways, i.e. there may e.g. be clear, translucent sections on the element so that this may form a window or a transparent door, or the element may be completely opaque, so that the element may form a window shutter, a door or the like.

I claim:

1. A toy building set containing building elements, said toy building set including at least one of a first type of a wall element, at least one of a second type of wall element and at least one plate element, each of said wall elements comprising:

a rectangular base face;

a top face;

two opposing side walls;

an inner facade face; and an outer facade face opposite said inner facade face;

wherein said outer facade face of said first type of wall element has an opening defined by said plurality of side walls, said side walls having adjacent thereto at least one hinge part;

wherein said inner facade face of said second type of wall element has a plurality of partitions which with said plurality of side walls define a plurality of openings said side walls of each of said plurality of openings having adjacent thereto at least one hinge part;

wherein said first type of wall element has identical outer dimensions as said second type of wall element wherein a height of each of said plurality of openings of said second type of wall element is equal to a height of said opening of said first type of wall element so that said plate element is removably and pivotably mountable in said at least one hinge part of either of said first wall element or said second wall elements;

and wherein said second type of wall element is a single integral structure.

2. A toy building set containing building elements, said toy building set including at least one of a first type of a wall element, at least one of a second type of wall element and at least one plate element, each of said wall elements comprising:

a rectangular base face;

a top face;

two opposing side walls;

an inner facade face; and an outer facade face opposite said inner facade face;

wherein said outer facade face of said first type of wall element has an opening defined by said plurality of side walls, said side walls having adjacent thereto at least one hinge part;

wherein said inner facade face of said second type of wall element has a plurality of partitions which along with portions of said side walls define a plurality of openings said side wall portion of each of said plurality of openings having adjacent thereto at least one hinge part;

wherein a height of each of said plurality of openings of said second type of wall element is equal to a height of said opening of said first type of wall element so that said plate element is removably and pivotably mountable in said at least one hinge part of either of said first wall element or said second wall element;

and wherein the overall height of said first type of wall element is equal to the overall height of said second type of wall element.

3. A toy building set according to claim 1 or 2 wherein each of said at least one hinge part of said first type of wall element is positioned interiorly of said outer facade face and each of said at least one hinge part of said second type of wall element is positioned interiorly of said inner facade face.

4. A toy building set according to claim 1 or 2 wherein one side of said opening of said first type of wall element includes said at least one hinge part and wherein one side of each of said plurality of openings of said second type of wall element includes said at least one hinge part.

5. A toy building set according to claim 1 or 2 wherein each of two sides of said opening of said first type of wall element includes said hinge part and wherein each of two sides of each of said plurality of openings of said second type of wall element includes said hinge part.

6. A toy building set according to claim 1 or 2, wherein said opening of said first type of wall element and each of said plurality of openings of said second type of wall element is formed with engagement means which protrude into the openings so that the plate element is prevented from pivoting into the openings.

* * * * *

UNITED STATES PATENT AND TRADEMARK OFFICE

CERTIFICATE OF CORRECTION

PATENT NO. : 5,803,783

DATED : September 8, 1998

INVENTOR(S) : Berit Holmstrom et al.

It is certified that error appears in the above-identified patent and that said Letters Patent is hereby corrected as shown below:

On the title page, Item [54], and col. 1, lines 1-2, the title should read -- A TOY BUILDING SET --.

Signed and Sealed this

First Day of December, 1998

*Attest:*

*Attesting Officer*

Bruce Lehman

BRUCE LEHMAN

*Commissioner of Patents and Trademarks*